US005096082A

United States Patent [19]

Hoefler

[11] Patent Number: 5,096,082

[45] Date of Patent: Mar. 17, 1992

[54] NON-SPILL BEVERAGE CONTAINER

[76] Inventor: Raphael A. Hoefler, 15752 Bluebird La., Huntington Bch., Calif. 92649

[21] Appl. No.: 691,224

[22] Filed: Apr. 25, 1991

[51] Int. Cl.[5] ..... B65D 51/20

[52] U.S. Cl. ..... 220/257; 220/255; 220/259

[58] Field of Search ..... 220/255, 256, 257, 259, 220/269

[56] References Cited

U.S. PATENT DOCUMENTS

| | | | |
|---|---|---|---|
| 3,319,842 | 5/1967 | Miller | 222/479 |
| 3,323,693 | 6/1967 | Miller | 222/479 |
| 3,952,914 | 4/1976 | Vogt | 220/339 |
| 4,039,101 | 8/1977 | Wells | 220/269 |
| 4,122,970 | 10/1978 | Amabili | 220/256 |
| 4,394,928 | 7/1983 | Philip | 220/366 |
| 4,463,866 | 8/1984 | Mandel | 220/269 |
| 4,930,655 | 6/1990 | Wells | 220/258 |
| 4,979,635 | 12/1990 | Levine | 220/269 |

*Primary Examiner*—Gary E. Elkins
*Assistant Examiner*—Nova Stucker

[57] ABSTRACT

An improved beverage container for preventing spills comprising a walled vessel, into which is formed a hingable tab. The tab can obtain closed, narrow-opened, and wide-opened positions through a tab pressing element pivotably mounted on the container. In the opened positions, the tab defines an aperture through which the beverage can flow. One end of a compliant flap is mounted on the inside of the container such that the other end, in a preferred primary position, completely covers the aperture, thereby preventing the beverage from flowing through the aperture. The flap obtains a secondary position when the tab is set in a narrow-open position and thereby forcing the flap away from the aperture, allowing fluid to flow therethrough. A person's upper lip may also press the flap away from the aperture during the process of drinking from the vesseel, thereby permitting the beverage to flow through the aperture. Should the flap be in the primary position, blocking beverage flow through the aperture, and the container inadvertently tipped onto its side, the beverage will not flow through the aperture.

4 Claims, 3 Drawing Sheets

NON-SPILL BEVERAGE CONTAINER

FIELD OF THE INVENTION

This invention relates to beverage containers. More specifically, this invention relates to beverage containers with means for preventing accidental spillage.

BACKGROUND OF THE INVENTION

Beverages may be purchased in a variety of containers, such as bottles, cups, and aluminum cans. Such beverage containers typically have an opening or aperture sufficient to allow the beverage to pass therethrough with no difficulty, and, as such, are prone to accidental spillage if inadvertently tipped over.

Several devices exist to prevent accidental spillage from such containers. For example, a simple flexible cap for bottles is available that is simply pressed down over the spout of a bottle. This device prevents spillage, and has an added benefit of maintaining an air-tight seal within the bottle to help keep a carbonated beverage sufficiently carbonated. However, a drawback to this device is that a person cannot drink from the bottle when the device is being used, making the device somewhat inconvenient.

Another non-spill device is in the form of a container and container cover that only allows liquid to pass through fluid ports in the container cover if the device is in a horizontal orientation. The goal of this invention is to provide a container that will not allow liquid to escape therefrom when vertically shaken or jostled. Clearly, however, when the container is inadvertently tipped onto its side the contents are spilled. Consequently this device does not provide adequate non-spill protection for drinking containers.

Another device in the form of a flexible cover for a drinking cup fits over the rim of the cup. When a person's upper lip is pressed against a flexible flap of the cover, the flap is forced away from an opening in the cover, thereby providing a path through which liquid may leave the drinking cup. This invention does not completely prevent spillage, however, as the opening in the cover is slightly larger than the flexible flap since it is formed from the same flexible sheet. Further, some people do not wish their lips to come into contact with the flexible flap, as their lips are sensitive or have cosmetics applied thereon, and the like. This device does not provide an easy method of removing the flexible flap. In addition, the device is designed for use with open ended drinking cups, and will not fit onto nor function properly with aluminum cans.

A considerable number of beverages are sold in aluminum cans throughout the world every day. Yet, an adequate non-spill device for such cans is not available. Clearly there is a need for a simple, yet effective, non-spill device for an aluminum can that allows the user to drink from the can while the device is in place, and further provides an easy method of eliminating contact between the device and a person's lips, if desired. The present invention fulfills these needs and provides further related advantages.

SUMMARY OF THE INVENTION

The present invention is a beverage container for preventing spills comprising a walled vessel with a portion thereof for supporting an opening means, such as that found on the common aluminum beverage can. A hingable tab formed contiguous with the container may be positioned in at least three alternate positions. The closed position is contiguous with the container and provides a seal formed therebetween. A tab narrow open position and a tab wide open position each define an aperture in the container to allow liquid to pass therethrough.

One end of a compliant flap is mounted on the inside surface of the container such that, in a primary position, the flap is in contact with the aperture, and in a secondary position, the flap is held away from the aperture by the tab, the tab being in the tab narrow open position. The flap can obtain the primary position only if the tab is in the closed position or the tab wide open position.

In operation, before the device is opened, a beverage liquid is contained in the device with an air-tight seal. A pivotable lever, such as that found on the standard aluminum beverage container, is used to force the hingable tab into one of its other positions. In the tab narrow open position, the tab forces the flap away from the aperture, and the beverage can be removed from the device in a normal manner. In the tab wide open position, the tab has forced the flap away from the aperture only briefly, the flap assuming its primary position against the aperture when the tab is pivoted completely out of the path of the flap. Consequently, if the container is oriented horizontally the beverage will be contained within the container as the flap covers the aperture. To drink from the device with the tab in the tab wide open position and the flap in the primary position, a person's upper lip will press against the flap, causing the flap to momentarily move away from the aperture and allowing the beverage to pass therethrough.

This device achieves a simple method of preventing spills from an aluminum can while also preventing insects and the like from entering the container. Moreover, a person using the device can choose whether or not to put the flap in the primary or secondary position, depending upon his preference. This device is also relatively inexpensive to manufacture, requiring only one additional component than the standard aluminum can. Other features and advantages of the present invention will become apparent from the following more detailed description, taken in conjunction with the accompanying drawings, which illustrate, by way of example, the principles of the invention.

DESCRIPTION OF THE DRAWINGS

The accompanying drawings illustrate the invention. In such drawings.

DETAILED DESCRIPTION OF THE PREFERRED EMBODIMENT

Figure 2:
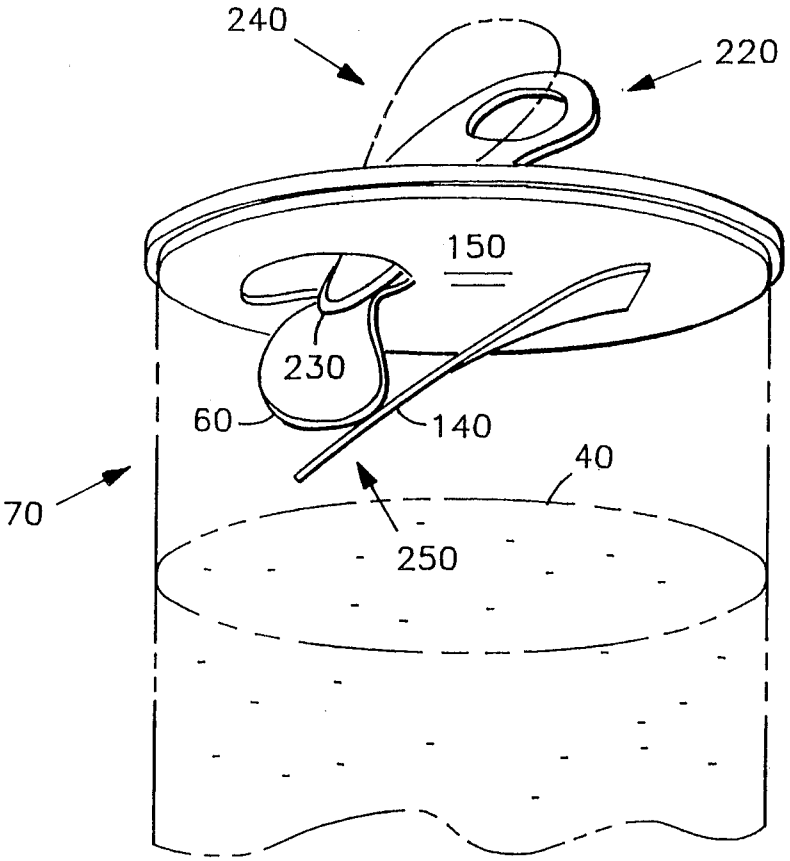
FIG. 2 is a cut-away perspective illustration of the invention, illustrating the tab in a tab narrow open position and a beverage liquid and a level in phantom outline.
Figure 1:
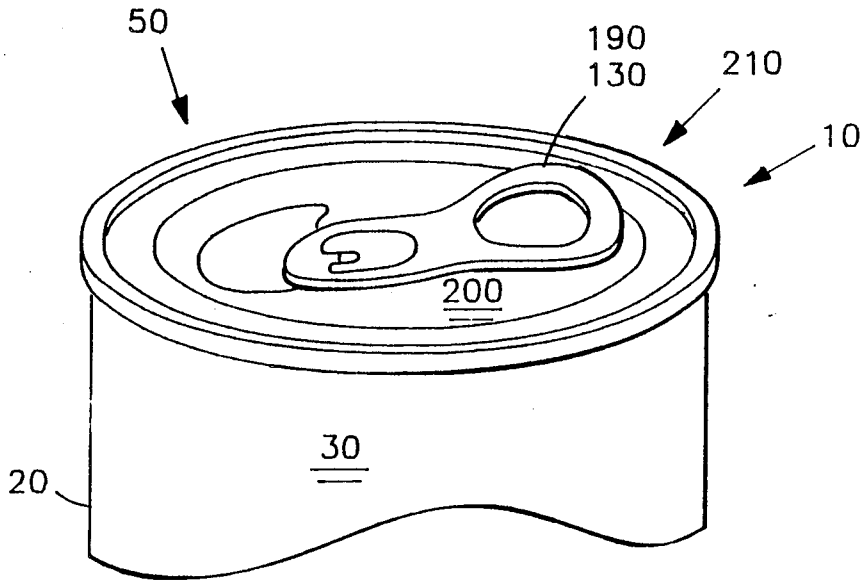
FIG. 1 is a perspective illustration of the invention, illustrating a tab in a closed position.

FIGS. 1 and 2 show a beverage container 10 for preventing spills. A vessel 20 having walls 30 for containing a liquid 40 for drinking has at least one portion 50 for supporting an opening means 60 of the container 10. A hingable tab 70, formed as a part of the one portion 50, is positionable in at least three alternate positions, namely, a closed position 80 contiguous with the walls 30 for sealing the vessel 20, a tab narrow open position 90, and a tab wide open position 100. Both the tab narrow open position 90 and the tab wide open position 100 of the tab 70 define an aperture 110 in the one portion 50. The tab 70 is partly separated from the one portion 50 with the partly separated portion 120 lying within the aperture 110. Preferably, the vessel 20 and the tab 70 are made of the same lightweight, yet strong, material, such as aluminum or plastic.

A tab pressing means 130 forces the tab 70 to assume the tab narrow open position 90 or the tab wide open position 100. Preferably, the tab pressing means 130 comprises a pivotable lever 190 attached to an outside surface 200 of the one portion 50 adjacent to the tab 70, and is positionable in at least three alternate positions, namely, a first position 210 lying generally parallel to the outside surface 200 (FIG. 1); a second position 220 where one end 230 of the lever 190 is pressed against the tab 70, forcing the tab 70 into the tab narrow open position 90, and a third position 240 where the one end 230 of the lever 190 is pressed against the tab 70, forcing the tab 70 into the tab wide open position 100 (FIG. 2).

Figure 5:
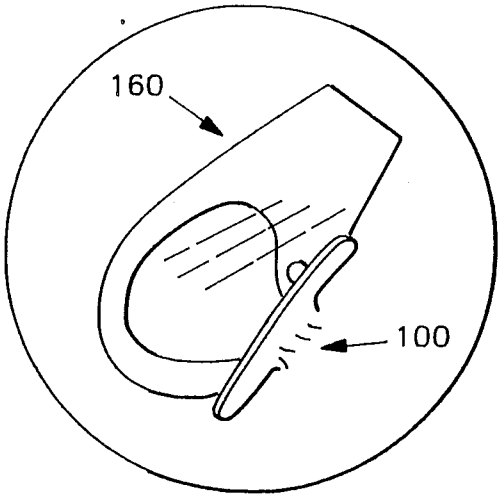
FIG. 5 is a bottom plan view of one portion of the invention, illustrating the tab in a tab wide open position and the flap in the primary position.
Figure 4:
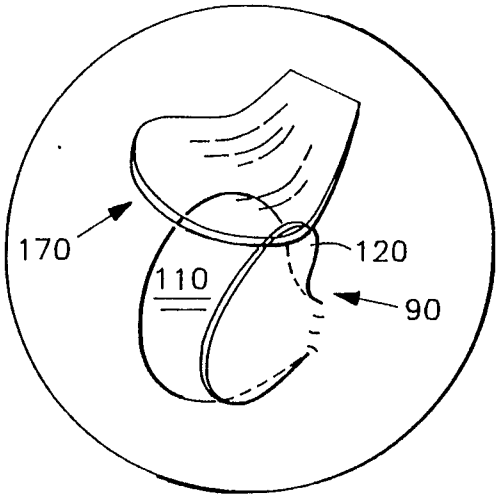
FIG. 4 is a bottom plan view of one portion of the invention, illustrating the tab in the tab narrow open position and the flap in a secondary position.
Figure 3:
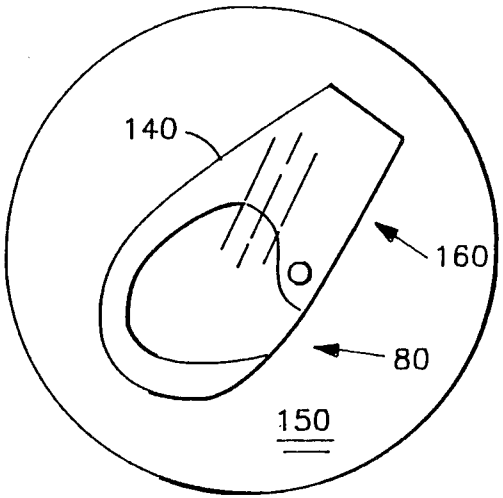
FIG. 3 is a bottom plan view of one portion of the invention, illustrating the tab in the closed position and a flap in a primary position.

A compliant flap 140, one end of which is mounted on an inside surface 150 of the one portion 50, is positionable in at least two alternate positions, namely, a preferred primary position 160 wherein the flap 140 is in contact with the aperture 110 (FIGS. 3 and 5), and a secondary position 170 wherein the flap 140 is not in contact with the aperture 110 (FIG. 4). The primary position 160 of the flap 140 is obtained when the tab 70 is in either the closed position 80 or the tab wide open position 100. The secondary position 170 of the flap 140 is obtained when the tab 70 is in the tab narrow open position 90, whereby the flap 140 is forced away from the aperture 110. The flap 140 may also be forced away from the aperture 110 when the one end 230 of the lever 190 is pressed against the flap 140 (not shown), as when the tab 70 is in the tab wide open position 100 and the tab pressing means 130 is in the third position 240. Preferably, the flap 140 is made from a thin sheet of flexible plastic 250.

Figure 6:
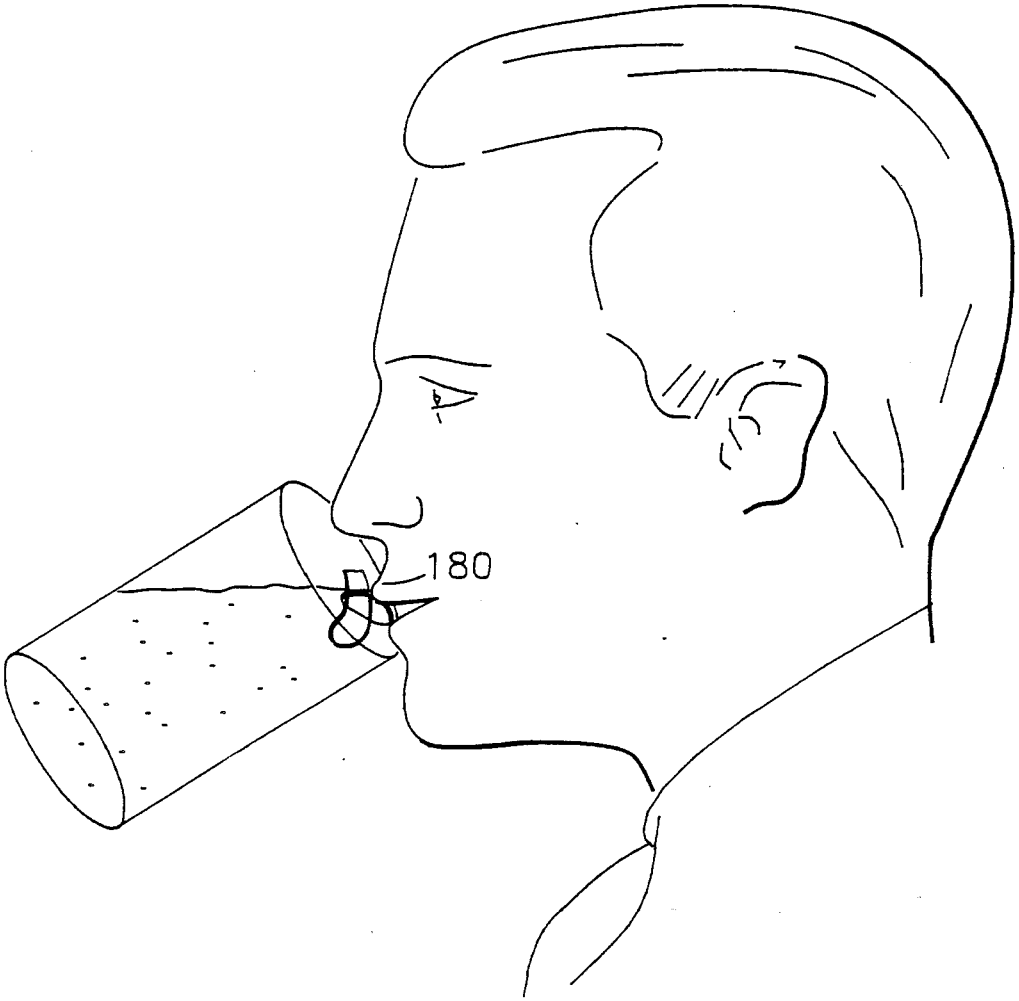
FIG. 6 is a perspective view of a person drinking from the invention, his upper lip pushing the flap into the secondary position.
Figure 7:
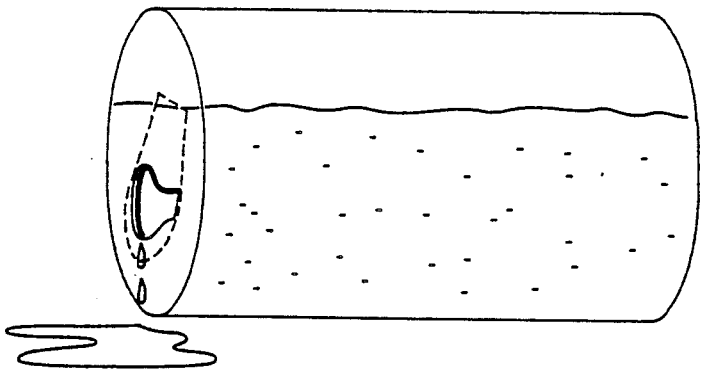
FIG. 7 is a perspective illustration of the invention, illustrating the device in a horizontal orientation and preventing spillage of the beverage.

In operation, the container 10 may be most easily drained through the aperture 110 when the flap 140 is in the secondary position 170. When the flap 140 is in the primary position 160, the liquid 40 is prevented from spilling out of the aperture 110 since the flap 140 blocks direct access of the liquid 40 to the aperture 140 (FIG. 7). However, the flap 140 may be forced away from the aperture 110 when an upper lip 180 is pressed against the flap 140 during the process of drinking directly from the vessel 20, thereby allowing the liquid 40 to flow around the flap 140 to exit the vessel 20 via the aperture 110 (FIG. 6).

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A beverage container for preventing spills, comprising:

a vessel having walls for containing a liquid for drinking, said walls having at least one portion for supporting means for opening said container;

a hingable tab forming a part of said one portion, the tab being positionable in at least three alternate positions, namely, a closed positioncontiguous with the walls for sealing said vessel, a tab narrow open position, and atab wide open position, wherein, both of said open positions of said tab define an aperture in said one portion, the tab being partly separated from the one portion;

a means for pressing the tab for forcing said tab to assume the tab narrow open or tab wide open position; and a compliant flap, one end of said flap being mounted on the inside surface of said one portion, the flap being positionable in at least two alternate positions, namely, a primary position wherein the flap is in contact with the aperture when the tab is in either the closed position or the wide open position, and a secondary position wherein the flap is not in contact with the aperture, the flap being forced away from the aperture by the tab having assumed the tab narrow open position, whereby with the flap in the secondary position the container may be most easily drained through the aperture, and with the flap in the primary position the liquid is prevented from spilling out of the aperture since the flap blocks direct access of the liquid to the aperture except when the flap is pressed inwardly, thereby forcing the flap away from the aperture and allowing the liquid to flow around the flap to exit the vessel via the aperture.

2. A beverage container for preventing spills, comprising:

a vessel having walls for containing a liquid for drinking, said walls having at least one portion for supporting means for opening said container;

a hingable tab forming a part of said one portion, the tab being positionable in at least three alternate positions, namely, a closed position contiguous with the walls for sealing said vessel, a tab narrow open position, and a tab wide open position, wherein, each of said open positions of said tab defines an aperture in said one portion;

a pivotable lever attached to the outside surface of said one portion adjacent to said tab, the lever being positionable in at least three alternate positions, namely, a first position lying parallel to the outside surface, a second position where one end of said lever is pressed against the tab forcing the tab into the tab narrow open position, and a third position where said one end of said lever is pressed against the tab forcing the tab into the tab wide open position;

a compliant flap mounted at one end on the inside surface of said one portion, the flap being positionable in at least two alternate positions, namely, a primary position wherein the flap is in contact with the aperture when the tab is in either the closed position or the wide open position, and a secondary position wherein the flap is not in contact with the aperture, the flap being forced away from the aperture by the tab having assumed the tab narrow open position, whereby the container initially being filled and sealed, having the tab, lever, and flap in the closed, first and primary positions respectively, the container being opened to assume a first configuration defined as having the lever in the second position, tab in the tab narrow open position and flap in the secondary position, wherein said liquid may be gravity drained from the vessel through the aperture, or alternately the container may be opened into a second configuration defined as having the lever in the third position, and the tab in the tab wide open position, thus allowing the flap to resume the primary position, the first configuration not preventing a spill should the container be knocked over, the second configuration providing for the prevention of said liquid from spilling from the container due to the compliant flap being forced against the aperture by the pressure of the liquid, the container still being easily emptied by pressing against the flap thus forcing the flap away from the aperture during the gravity draining of said liquid from said vessel.

3. The beverage container of claim 2 wherein said flap is a thin sheet of flexible plastic.

4. An anti-spill device for use in a metal beverage can of the type having enclosed end caps, one end cap having a tab defined by a scored line in said one end cap, the tab capable of being partly torn away from said one end cap by pressing said tab into said can so that the tab forms a projection away from said end cap toward the interior of said can thereby leaving an opening in said end cap for the removal of a liquid, the anti-spill device comprising:

a flexible flap attached at one end of said flap to the interior surface of the one end cap, the flap normally lying in contact with said interior surface and covering said opening, the flap being capable of being flexed into a position away from said interior surface by said projection thereby allowing normal outflow of said liquid from said can, the relative positions of said projection and said flap being such that for at least one position of said projection said tab allows said flap to move back into contact with said opening; whereby said flap acts to prevent spilling of said liquid upon an upset of said can, while allowing normal drinking of said liquid by a person pressing the upper lip of said persons mouth against said flap to unseat said flap thereby allowing said liquid to bypass said flap to reach said opening for outflow.

* * * * *